US006168172B1

(12) United States Patent
Meibock et al.

(10) Patent No.: US 6,168,172 B1
(45) **Date of Patent: *Jan. 2, 2001**

(54) IN-LINE ROLLER SKATE

(75) Inventors: Antonin A. Meibock, Calgary (CA); John E. Svensson, Vashon, WA (US)

(73) Assignee: K-2 Corporation, Vashon, WA (US)

( * ) Notice: Under 35 U.S.C. 154(b), the term of this patent shall be extended for 0 days.

This patent is subject to a terminal disclaimer.

(21) Appl. No.: 08/668,278

(22) Filed: Jun. 21, 1996

Related U.S. Application Data

(63) Continuation-in-part of application No. 08/484,467, filed on Jun. 7, 1995, now abandoned, which is a continuation of application No. 08/094,576, filed on Jul. 19, 1993, now Pat. No. 5,437,466.

(51) Int. Cl.[7] ..... A63C 17/06
(52) U.S. Cl. ..... 280/11.221; 36/89; 36/115
(58) Field of Search ..... 280/11.221, 11.23, 280/11.19; 36/115, 116, 84, 87, 89, 92, 105, 107, 34 B, 68, 69

(56) References Cited

U.S. PATENT DOCUMENTS

| | | |
|---|---|---|
| D. 327,360 | 6/1992 | Graham . |
| D. 327,565 | 7/1992 | Graham . |
| 334,739 | 1/1886 | Blum . |
| D. 344,119 | 2/1994 | Johnson et al. . |
| 1,610,700 | 12/1926 | Morton . |

(List continued on next page.)

FOREIGN PATENT DOCUMENTS

| | | |
|---|---|---|
| 2038315 | 9/1991 | (CA) . |
| 602 147 | 7/1978 | (CH) . |
| 8807537 | 9/1988 | (DE) . |
| 9208063 U | 10/1992 | (DE) . |
| 0 117 371 A1 | 9/1984 | (EP) . |
| 0 567 948 A1 | 11/1993 | (EP) . |
| 0 568 878 A1 | 11/1993 | (EP) . |
| 0 596 281 A1 | 5/1994 | (EP) . |
| 1 136 599 | 5/1957 | (FR) . |
| 81 17812 | 9/1981 | (FR) . |
| 2 558 351 | 1/1984 | (FR) . |
| 87 14884 | 10/1987 | (FR) . |
| 2 585 260 | 5/1988 | (FR) . |
| 90 12977 | 10/1990 | (FR) . |
| 2 659 534 | 9/1991 | (FR) . |
| WO 95/15094 | 6/1995 | (WO) . |
| WO 95/15095 | 6/1995 | (WO) . |

OTHER PUBLICATIONS

Declaration of George Sticker with Exhibits A and B, Jun. 12, 2000.
Declaration of John H. Dewall with Exhibit A, Jun. 10, 2000.
Declaration of Ryui Sakamoto with Exhibit A, Jun. 12, 2000.
Declaration of Gregory A. Nelson with Exhibit A, Jun. 5, 2000.
Declaration of Adam A. Luedke with Exhibit A, Jun. 9, 2000.
Declaration of Kimberly A. Pavek, Jun. 11, 2000.

(List continued on next page.)

*Primary Examiner*—Anne Marie Boehler
(74) *Attorney, Agent, or Firm*—Christensen O'Connor Johnson Kindness PLLC

(57) ABSTRACT

A skate for receiving a foot of a skater includes a frame holding in-line wheels. A rigid base is securely attached to the frame. An external heel counter extends upwardly from the base around the heel portion of the skate. An upper having an outer shell of substantially soft pliable material extends upwardly from the base. A substantially rigid internal heel counter is disposed beneath the outer shell. The internal heel counter extends around the heel area of the skate above the top of said external heel counter. A substantially rigid ankle support cuff is pivotally coupled to the internal heel counter and disposed beneath the outer shell.

22 Claims, 14 Drawing Sheets

U.S. PATENT DOCUMENTS

| | | |
|---|---|---|
| 1,798,590 | 3/1931 | Collis . |
| 1,868,548 | 7/1932 | Turner . |
| 2,147,455 | 2/1939 | Murray . |
| 2,362,824 | 11/1944 | Hueston . |
| 2,763,071 | 9/1956 | C.H.K. Napier . |
| 2,868,553 | 1/1959 | Rieckman . |
| 2,909,375 | 10/1959 | Warner . |
| 2,998,260 | 8/1961 | Meyer . |
| 3,437,344 | 4/1969 | Shevelson . |
| 3,807,062 | 4/1974 | Spier . |
| 4,275,895 | 6/1981 | Edwards . |
| 4,351,537 | 9/1982 | Seidel . |
| 4,385,456 | 5/1983 | Livernois et al. . |
| 4,418,929 | 12/1983 | Gray . |
| 4,531,537 | 7/1985 | Smith . |
| 4,563,825 | 1/1986 | Tesser . |
| 4,654,985 | 4/1987 | Chalmers . |
| 4,719,926 | 1/1988 | Nelson . |
| 4,773,658 | 9/1988 | Bourque et al. . |
| 4,776,111 | 10/1988 | Crowley . |
| 4,783,911 | 11/1988 | Brown . |
| 4,835,885 | 6/1989 | Hoshizaki et al. . |
| 4,909,523 | 3/1990 | Olson . |
| 4,936,295 | 6/1990 | Crane . |
| 4,964,229 | 10/1990 | Laberge . |
| 5,028,058 | 7/1991 | Olson . |
| 5,031,341 | 7/1991 | Paris et al. . |
| 5,048,848 | 9/1991 | Olson et al. . |
| 5,052,701 | 10/1991 | Olson . |
| 5,068,956 | 12/1991 | Malewicz . |
| 5,090,138 | 2/1992 | Borden . |
| 5,092,614 | 3/1992 | Malewicz . |
| 5,171,033 | 12/1992 | Olson et al. . |
| 5,177,884 | 1/1993 | Rullier . |
| 5,184,834 | 2/1993 | Yu . |
| 5,210,963 | 5/1993 | Harwood . |
| 5,226,875 | 7/1993 | Johnson . |
| 5,331,752 | 7/1994 | Johnson et al. . |
| 5,342,070 | 8/1994 | Miller et al. . |
| 5,380,020 | 1/1995 | Arney et al. . |
| 5,393,078 | 2/1995 | Bourdeau . |
| 5,397,141 | 3/1995 | Hoshizaki et al. . |
| 5,437,466 | 8/1995 | Meibock et al. . |
| 5,480,168 * | 1/1996 | Chen ..... 280/11.22 |
| 5,499,461 | 3/1996 | Danezin et al. . |
| 5,678,330 | 10/1997 | Van Dyke et al. . |
| 5,775,008 | 7/1998 | Bussell et al. . |

OTHER PUBLICATIONS

Declaration of Mari J. Frederickson with Exhibit A, Jun. 12, 2000.

Declaration of Louis F. ("Rick") Polk III, pp. 1, 3, 4, 5, 8 and Exhibits D and E, Jun. 12, 2000.

Parduba, J., declaration and photos (Nov. 1999).

Alpina, "alpina 91–92," *NNN–BC Telemark.*

Artex, "Artex Cross–Country System," Skiroll ATX 67.

Alpina, "Cross Country Ski Boots," Sep. 1991 Rottefella.

Salomon, "Salomon," SR 811 and SR Profil Skate & Classic.

* cited by examiner

IN-LINE ROLLER SKATE

RELATED APPLICATIONS

This is a continuation-in-part of utility application Ser. No. 08/484,467, filed Jun. 7, 1995, now abandoned which is a continuation of utility application Ser. No. 08/094,576, filed Jul. 19, 1993, now U.S. Pat. No. 5,437,466.

FIELD OF THE INVENTION

The present invention relates to in-line roller skate constructions and, more particularly, to pivoting ankle support structures for in-line roller skates.

BACKGROUND OF THE INVENTION

In-line roller skates typically include a plurality of aligned wheels with parallel axles secured to a skate frame. A skate boot or shoe is attached to the top of the frame. Most skate manufacturers currently construct the boots and shoes (the "skate upper") with a base, a plastic shell extending upwardly from the base, and a removable liner. The shell may include a cuff portion pivotally attached to a lower portion of the shell to ease fore and aft movement of the skater's leg while providing medial and lateral support. Alternatively the plastic shell may extend upwardly to the top of the skate above the ankle without the cuff being pivotally secured to the lower portion. Rigid hockey skates are also in the prior art. These skates typically do not have a plastic outer shell. Hockey skates may have a leather or leather/nylon outer shell with internal stiffening/support members. While hockey skate constructions provide necessary support for this sport they do not easily flex forwardly and rearwardly.

Most in-line roller skates are very maneuverable and are capable of higher speeds than those customarily associated with conventional paired wheel roller skates. In-line roller skating is generally considered to require higher levels of skill, coordination, and strength than conventional paired wheel roller skating because of the narrow, lateral support base associated with in-line roller skates. Specifically, while balancing in the forward and rear direction is relatively easy for even inexperienced skaters, balancing in the sideward or lateral direction is difficult because of the narrow support base and is heavily dependent upon the skater's balancing and coordination skills. Proper ankle and foot supports within the upper shoe portion of the in-line roller skate aid in lateral balancing.

To obtain the optimum performance from an in-line roller skate, it is important that the in-line roller skate be maintained in a substantially vertical position. The upper shoe portion of the in-line roller skate serves competing purposes of providing support and comfort; comfort in a shoe not usually being associated with a high degree of support. In other words, the incorporation of rigid support structures in the upper shoe portion of the in-line roller skate tends to add stiffness and bulk and, considering the warm weather environments conducive to in-line roller skating, tends to make the skates, heavy, hot, and uncomfortable. Because serious ankle and other injuries can result if comfort is favored over support, proper support in an in-line roller skate has been the dominant design criteria in the past.

As discussed briefly above, the conventional upper shoe portion of the in-line roller skate is usually formed of rigid, non-breathable, plastic materials having an inner liner. The plastic material generally forms the outer structure of the upper shoe portion, thereby requiring that a soft inner liner of sponge rubber or other like material be included to provide comfort to the user. Since such soft materials combined with the rigid plastic shell are good insulators and do not readily transmit heat or air away from the user's foot, the result is a hot upper shoe portion.

To provide lateral stability, conventional alpine ski boot designs have readily been adapted to in-line roller skates. These boots provide support and durability, characteristics necessary for in-line roller skates. U.S. Pat. Nos. 4,351,537 and 5,171,033 are both exemplary of rigid injection molded boots adapted to winter sports, such as ice skating and alpine skiing, which have been modified for in-line roller skating applications. These patents disclose an upper boot portion that comprises a hard plastic outer shell with a soft inner liner. While this type of boot design is well-suited for cold weather sports, the upper shoe portion tends to be hot and uncomfortable when used in warm weather sports such as in-line roller skating. The '033 patent suggests that by including "primarily unobstructed ventilation ports" in the rigid synthetic outer shell of the upper shoe portion, air can circulate around the skater's foot, thereby eliminating some of the heat associated with the hard plastic outer shell. While this patent seeks to address the issue of comfort, the disclosed upper shoe portion is still configured of two parts, including a hard plastic outer shell and a soft inner liner, which in warm weather conditions can be uncomfortable, compared to conventional walking and/or running shoes due to excessive heat buildup. The result is that the skater's feet are often hot, damp, and uncomfortable.

Another problem with the adoption of injection molded ski-type boots to in-line roller skating is that while providing excellent lateral stiffness and rigidity for lateral ankle support, these boots also create unnecessary and unwanted forward/rearward stiffness and rigidity. Ski-type boots detract from the performance characteristics of the skate because they limit the range of motion of the skater's legs and feet and therefore, the ability of the skater to utilize the full extent of his strength and agility.

Further, it is desirable for an in-line roller skate upper shoe portion to be lightweight. Boots that are well-suited to skiing applications wherein it is not necessary to raise and lower the boot with every movement of the foot (because the skier relies on gravity to provide the forward or downward motion) prove heavy and bulky when adapted to in-line roller skating. When skating on a flat surface, the in-line roller skater must lift the boot with every stride to provide a forward impetus, and a heavy upper shoe portion causes fatigue and reduces skating enjoyment.

Alternative modes of providing both comfort and adequate support for in-line roller skating have been suggested. Specifically, U.S. Pat. Nos. 3,963,252, 4,418,929, and 5,069,462 show roller skate frames that include a platform adapted to allow the skater to wear a conventional street shoe that is inserted into a series of braces and supports. These skates offer alternative shoe and frame designs to the rigid plastic outer shell and inner liner of the conventional in-line roller skate.

However, significant problems exist with such designs in that the adjustable braces and supports of these designs, while needed to accommodate numerous shoe sizes and shapes, are bulky and uncomfortable. Additionally, there is a limited range of shoe types that the skates will accommodate, and thus, there is the additional requirement that the skater have the proper shoe type to properly utilize the skate.

The outer plastic shells of previous in-line roller skates have created difficulty in styling the skates such as has been done with hiking boots and other footwear that have not had rigid outer shells. However, the rigid outer shells have thought to be necessary to provide adequate medial and lateral support while allowing ease of fore and aft movement of the leg of the skater relative to the skater's foot during skating. A recreational skater may not have the required strength and ability to utilize a low-cut skate which provides ease of movement. The skate would not provide enough lateral and medial support. Skates that do provide lateral and medial support and that do not include the rigid plastic outer shell construction include hockey skates. Hockey skates do provide adequate, lateral and medial support for the skater's ankle. However, fore and aft movement of the lower leg of the skater relative to the skater's foot is also limited. The hockey skate uppers are generally quite rigid and unforgiving. Therefore, a need exists to provide a skate that includes an upper structural support member for medial and lateral support while providing for ease of fore and aft movement without totally encompassing the skaters foot in a rigid plastic shell.

SUMMARY OF THE INVENTION

In accordance with the present invention a skate for receiving a foot of a skater is disclosed. The skate includes a frame, a rigid base, a substantially non-rigid upper portion, and a substantially rigid upper portion. The frame has a means for riding on a surface. The rigid base is securely attached to the frame. The base is adapted to support the bottom of the skater's foot and includes a heel portion and a toe portion adapted to support the areas beneath the heel, ball, and toes of the skater's foot. The substantially non-rigid upper portion is adapted to receive the skater's foot. It substantially covers the top and ankle of the skater's foot and is permanently affixed to the rigid base. The substantially rigid upper portion is coupled to the non-rigid upper portion and to the rigid base. The rigid upper portion includes an ankle support cuff extending above the skater's ankle when wearing the skate. The rigid upper portion is adjacent only portions of the non-rigid upper portion, leaving a substantial portion of the vamp of the skate without rigid support directly adjacent thereto. The non-rigid upper portion extends to above the cuff.

In the preferred embodiment of the invention the substantially non-rigid upper portion includes an outer shell. The ankle support cuff is disposed beneath the outer shell. In one aspect of the invention the substantially non-rigid upper portion also includes billows in a front portion and a rear portion of the ankle area of the upper portion. The billows are adapted to allow flexible movement of the substantially non-rigid upper portion.

In another preferred aspect of the invention the substantially rigid upper portion further includes an internal heel counter beneath the outer shell. The ankle support cuff is pivotally connected to the internal heel counter. An external heel counter may also extend upwardly from the base around the heel portion of the upper portion on the outside of the outer shell.

In one embodiment of the invention the internal heel counter and the ankle support cuff are pivotally interconnected with a reduced section of heel counter material, the heel counter and ankle support cuff being integrally formed.

In the preferred embodiment of the invention the heel counter includes two sides with recesses along the inner portion of the tops thereof. The ankle support cuff includes lower edges disposed at least partially within the recesses. Preferably, the recesses include grooves extending downwardly therein. The cuff includes downwardly projecting tongues on either side thereof disposed within the grooves. The recesses in the sides of the heel counter are preferably arcuate in shape and complementary arcuately shaped tongues exist on the sides of the cuff. The recesses are preferably disposed on the inner sides of the heel counter with the lower portion of the cuff overlapping the heel counter on the inner sides thereof.

A further aspect of the preferred embodiment of the invention includes substantially rigid support panels disposed on the sides of the interface between the heel counter and the ankle support cuff. The support panels are fixed to the heel counter such that the ankle support cuff is movable relative to the panels.

One aspect of an alternate embodiment of the invention includes arcuate slots within the arcuate portions of the heel counter. In this embodiment, the cuff further includes pins through the bottom arcuate portions thereof. The pins extend through the slots in the heel counter.

In another alternate embodiment of the invention the arcuate portions of the heel counter and the arcuate portions of the cuff are interconnected with arms attached therebetween. These arcuate portions of the heel counter preferably include recesses for receiving the arcuate portions of the cuff.

The preferred embodiment of the invention may also be described as a skate for receiving a foot of the skater that includes a frame, a rigid base, an external heel counter, an upper having an outer shell, a substantially rigid internal heel counter, and a substantially rigid ankle support cuff. The frame has wheels or a blade for riding on a surface. The rigid base is securely attached to the frame. The external heel counter extends upwardly from the base around the heel portion of the skate. The outer shell is constructed of substantially soft pliable material. The internal heel counter is disposed beneath the outer shell and extends around the heel area of the skate above the top of the external heel counter. The ankle support cuff is pivotally coupled to the internal heel counter and disposed beneath the outer shell. Preferably, the internal heel counter also includes at least one groove along at least a portion thereof for receiving the lower edge of the cuff in substantially sliding engagement therewith.

The above-described skate construction provides a skate that has great aesthetic appeal without substantial plastic material on the external body of the skate. The skate also provides superior lateral and medial support while allowing fore and aft movement of the lower leg of the skater relative to the skater's foot, with the cuff being pivotally secured within the upper.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
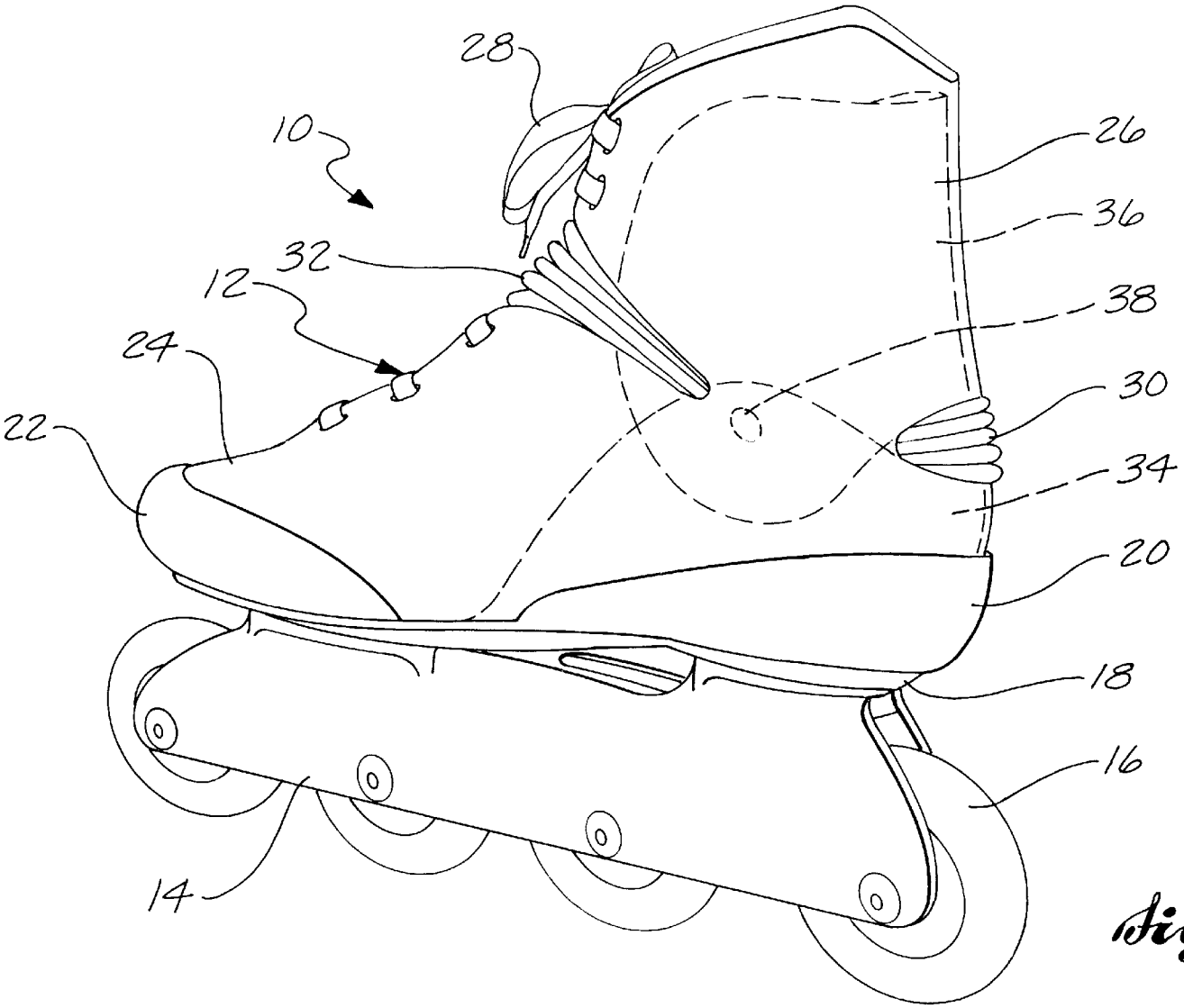
FIG. 1 is a perspective view of one embodiment of the present invention illustrating a soft boot skate with a rigid heel counter and cuff pivotally interconnected within the outer shell of the skate.

Referring to FIG. 1, an in-line roller skate 10 made according to the present invention is disclosed. In-line skate 10 includes an upper 12 connected to a frame 14, which secures wheels 16. Upper 12 includes a rigid base 18 for interconnection to frame 14. Preferably, rigid base 18 extends beneath upper 12 substantially from heel to toe. An external heel counter 20 is preferably integrally formed with base 18. Alternatively, external heel counter 20 could be omitted or formed separately, unattached to base 18. A toe cap 22 is also separately formed and attached to base 18 to protect the toe end of the skate from scuffs and wear. A toe cap 22 also protects the skater's foot from impacts with hard surfaces.

Most of the rest of upper 12 is constructed of soft, breathable, pliable material of the type commonly used in shoes or hiking boots. Thus, synthetic or natural leathers and meshes or other fabrics may be used to construct the soft portions of upper 12. These portions include a fore foot portion 24 generally below the ankle area of the skate and an ankle portion 26 at and above the ankle portion of the skate. Laces 28 are preferably used to secure upper 12 tightly around the foot of the skater in a conventional fashion. However, buckles, straps, Velcro™, or other fasteners may alternatively be used. In the preferred embodiment of the invention forward bellows 32 and aft billows 30 are secured within cutout portions of upper 12 just over the heel and between the ankle and fore foot portions 26 and 24 of upper 12. Forward and aft bellows 32 and 30 allow ease of flexing of ankle portion 26 relative to fore foot portion 24.

Much of the construction of the upper of the skate is similar to that disclosed in U.S. Pat. No. 5,437,466 incorporated herein by reference. The skate disclosed in the parent application (U.S. Pat. No. 5,437,466) includes a soft pliable upper. The upper disclosed in the '466 patent provides medial and lateral support as well as fore and aft flexibility with a rigid external heel counter pivotally interconnected with a rigid external cuff. The same concept is employed in the present invention. However, the present application provides further details and constructions with a rigid heel counter and cuff placed inside the relatively soft outer shell 44 of upper 12. An internal heel counter 34 is preferably attached to base 18 by connection to an outer shell 44 and a last board 52 (illustrated in FIG. 3). Internal heel counter 34 rises from base 18 beginning at approximately the middle of the sides of base 18 upwardly toward ankle portion 26 of upper 12. Internal heel counter 34 then gradually descends to a position below aft billows 30 at the rear of the heel portion of upper 12 and above external heel counter 20. Thus, internal heel counter 34 is cantilevered upwardly from external heel counter 20 except that it has outer shell 44 placed therebetween in the preferred embodiment.

Figure 2:
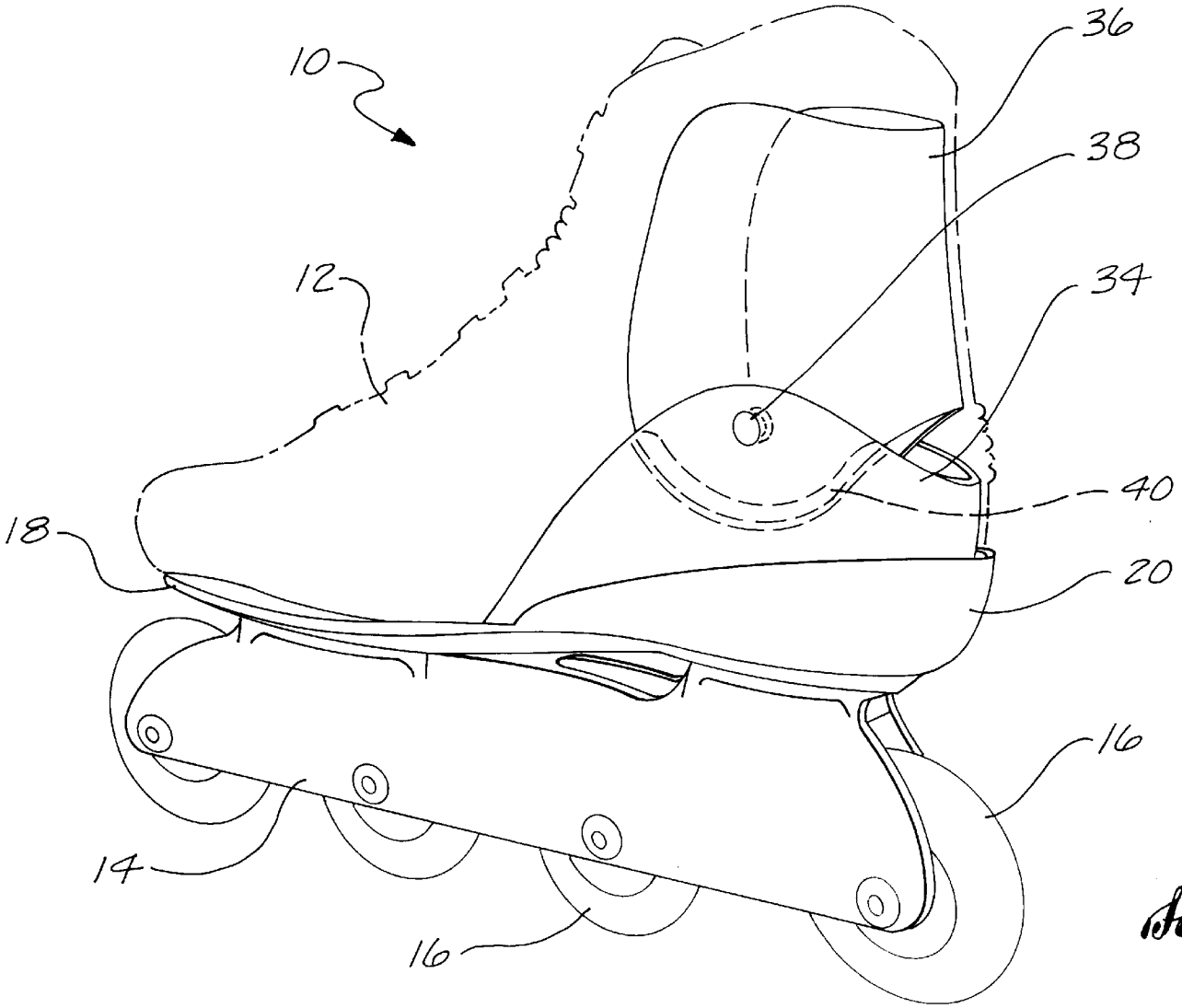
FIG. 2 is a perspective view of the skate of FIG. 1 showing the soft portion of the upper and the toe cap in phantom view.

FIG. 2 further illustrates the heel counter/internal cuff construction. The right and left sides of internal heel counter 34 are substantially the same except for variations due to differences in the anatomical shapes and movements between the medial and lateral sides of the skater's feet. The uppermost portion of both sides of internal heel counter 34 includes recesses with arcuate lower boundaries. The bottom of the recesses preferably includes grooves 40 into which an ankle cuff 36 is engaged with a tongue and groove configuration. Pivot pins 38 are secured at the radial centers of the arcuate portions and extend between ankle cuff 36 and internal heel counter 34. Preferably pivot pins 38 are rivets. Pivot pins 38 allow fore and aft movement of ankle cuff 36 relative to internal heel counter 34. Pivot pins 38 restrict lateral and medial flex of ankle cuff 36. Ankle cuff 36 is constructed of a rigid material such as plastic or fiber-reinforced plastic. The material is rigid relative to the softer portions of upper 12 that surround most of the rest of the foot of the skater. Ankle cuff 36 is preferably U-shaped as viewed from above such that it surrounds the lower leg of the skater and ankle of the skater from behind toward the front of the skate. Ankle cuff 36 preferably does not entirely surround the ankle or lower leg of the skater but preferably extends in front of the ankle bones. Thus, ankle cuff 36 provides medial and lateral support to the skater's ankle while allowing fore and aft flex about pivot pin 38. Ankle portion 26 of upper 12 is able to flex fore and aft with ankle cuff 36 since it is secured therearound and is of a softer, more flexible material than ankle cuff 36. Thereby, with the above described construction, a skate is provided that has the pleasing aesthetic appearance of a sport shoe or hiking boot with superior medial and lateral support and fore and aft flexibility that are required for in-line skating.

Figure 3:
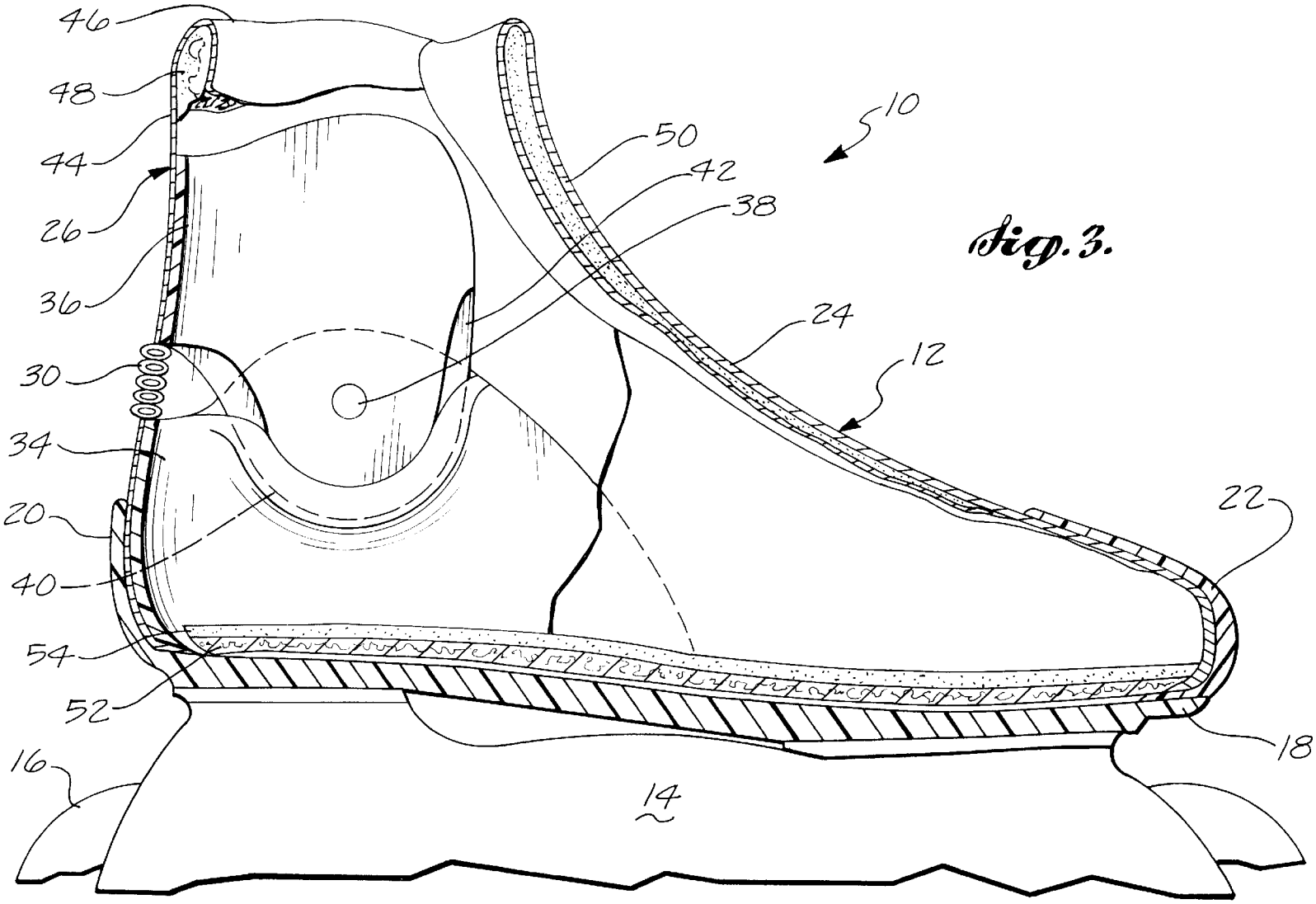
FIG. 3 is a cross-sectional side elevational view of the skate illustrated in FIGS. 1 and 2 with sections of the interior of the skate cut away to show the cuff/counter interface.
Figure 4:
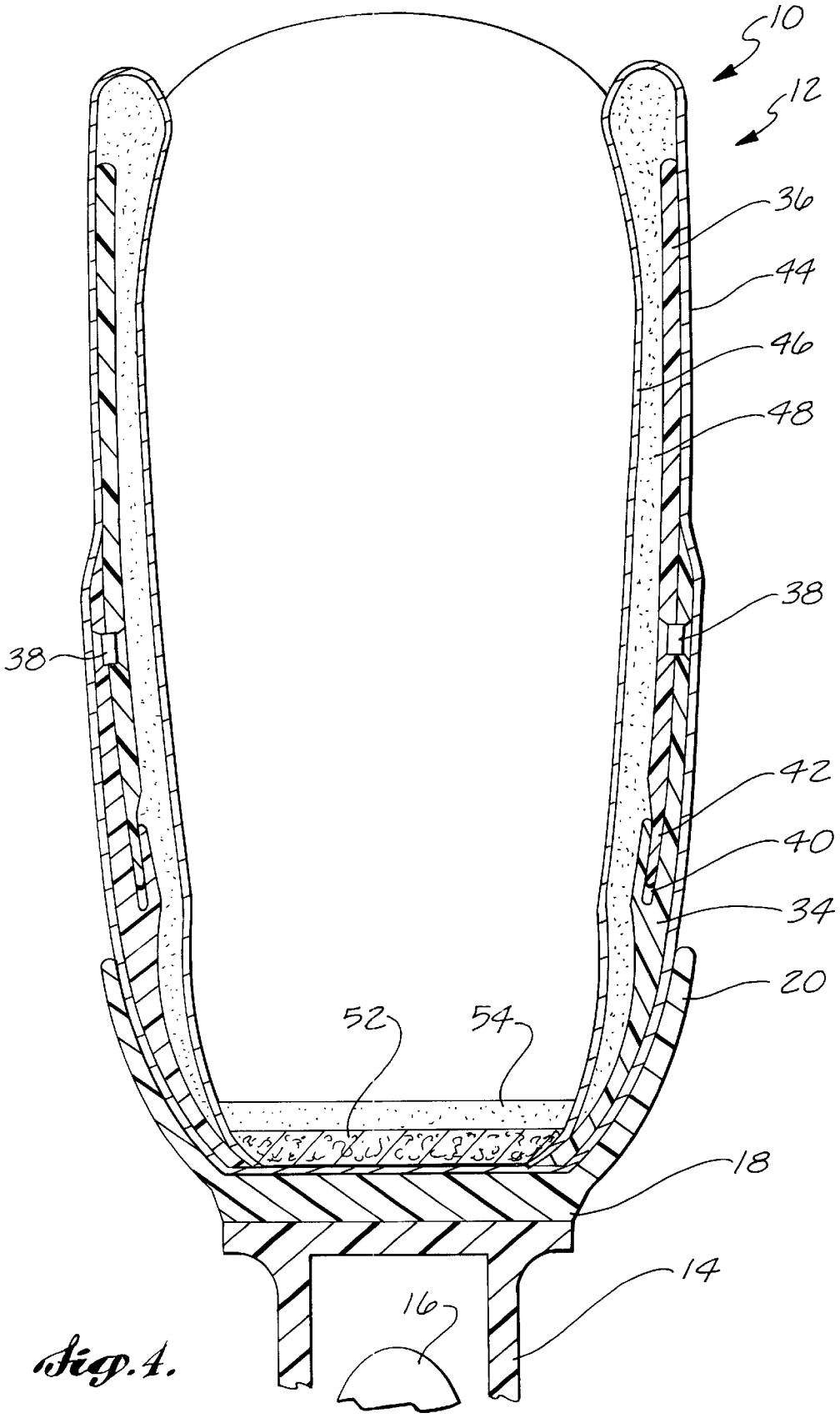
FIG. 4 is a cross-sectional elevational view cut vertically through the skate and extending through the pivot locations of the cuff.

The arrangement of pivot pin 38 and groove 40 with a cuff tongue 42 (as illustrated in FIGS. 3 and 4) provides a strong and supportive interconnection between ankle cuff 36 and internal heel counter 34. Both medial and lateral flex are restricted by both sides of ankle cuff 36 with this arrangement since there is a vertical space between pivot pin 38 and the tongue and groove arrangement.

FIG. 3 further illustrates the details of the layering of upper 12. As discussed above, a cuff tongue 42 extends downwardly from cuff 36 to interface with groove 40 of heel counter 34. Thus, a sliding arrangement exists between cuff 36 and heel counter 34 at the interface between the two with a semi-circular tongue and groove interface. The portion of internal heel counter 34 that extends above pivot pin 38 is preferably on the outside of ankle cuff 36 to provide additional support when any portion of cuff 36 is pushed outwardly in a medial or lateral direction.

As seen in FIGS. 3 and 4, upper 12 includes the outer shell 44 mentioned above substantially encompassing the majority of upper 12. Outer layer or shell 44 is preferably constructed of a leather or flexible man-made materials. Outer shell 44 is secured to base 18, toe cap 22, and external heel counter 20. Outer shell 44 extends to the top of upper 12 where it is preferably joined to an inner lining 46. Inner lining 46 lines the interior walls of upper 12. Inner lining 46 is preferably a breathable material such as a tricot or other conventional breathable lining. A soft padding 48 is secured between inner lining 46 and ankle cuff and internal heel counter 36 and 34. Padding 48 also preferably extends between inner lining 46 and outer shell 44 in areas that do not include heel counter 34 and cuff 36. Padding 48 is preferably a conventional padding such as an open cell foam material.

FIG. 3 also illustrates skate tongue 50 extending in a conventional manner in front portion of upper 12.

A last board 52 permanently secures the above-described portions of upper 12 to base 18. Preferably, rivets or other fasteners extend through frame 14, base 18 and last board 52. Adhesives are also used. Outer shell 44 as well as internal heel counter 34 extend at least partially beneath last board 52 to be sandwiched securely between last board 52 and base 18. The secure connection of upper 12 to base 18 provides a skate that is superior in performance to any skates that include removable liners since the foot of the skater can be more securely held within the skate and to the base and frame. An insole 54 is placed over last board 52 within skate upper 12.

Turning now to FIGS. 5–13, alternate embodiments of the invention will now be discussed. In the figures most details of the uppers are not illustrated to more clearly depict the arrangement of the cuffs and heel counters. Also note that the last two digits of each numbered element correspond to like-numbered elements in previous embodiments.

Figure 5:
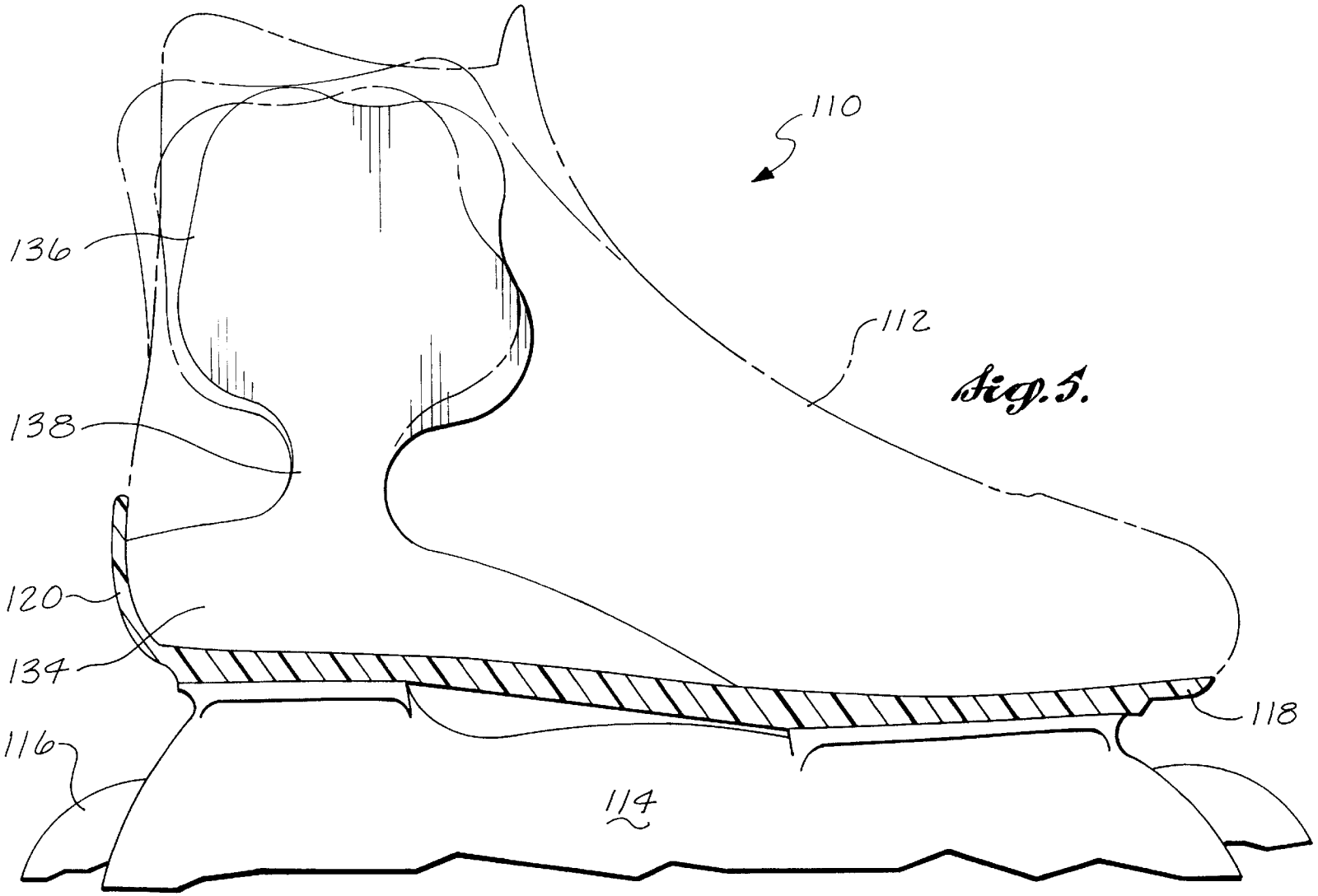
FIG. 5 illustrates an alternate embodiment of the present invention including a pivot neck between the heel counter and internal cuff.

FIG. 5 illustrates an alternate embodiment of the present invention. Note that like reference numbers are used throughout FIG. 5 except that the number 100 has been added to each. Internal heel counter 134 is connected to internal cuff 136 by a pivot neck 138. Pivot neck 138 is small enough so as to create a "live hinge" between cuff 136 and heel counter 134. In this embodiment, cuff 136 may either be in the form of side panels within the sides of upper 112 or may extend around the back of the skate in a generally U-shaped configuration. The details of most of upper 112 are not illustrated in FIG. 5 so as to more clearly represent internal heel counter 134, pivot neck 138, and internal cuff 136. The remaining details are similar to those disclosed above in connection with FIGS. 1 through 4. Movement of internal cuff 136 is also shown in phantom lines in FIG. 5. With cuff 136 having a U-shaped configuration, the structural integrity to provide medial and lateral support to the ankle of the skater is provided in a simple, low-cost, integral construction with internal heel counter 134 while fore and aft pivoting motion is still allowed.

Figure 6:
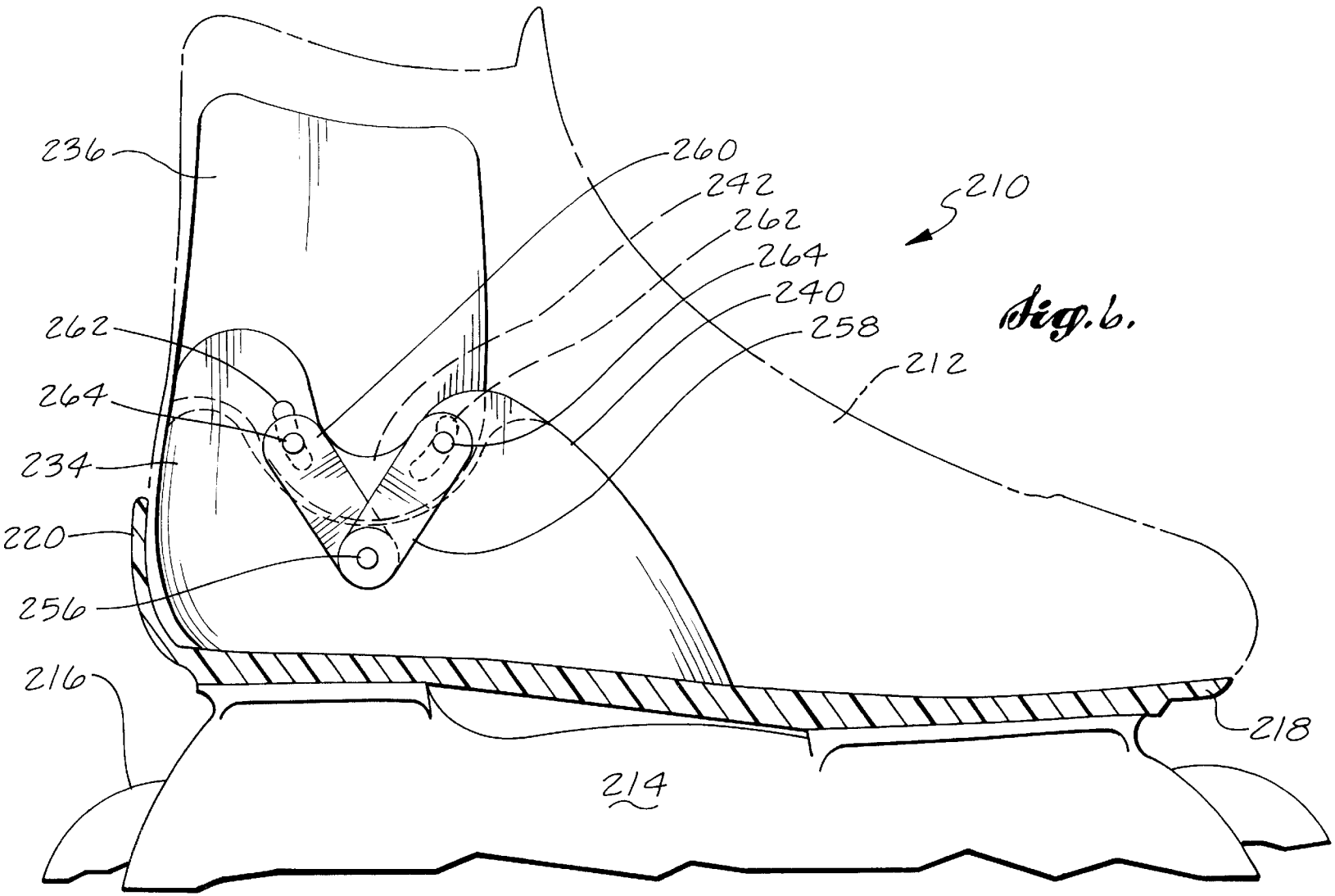
FIG. 6 illustrates an alternate embodiment of the invention illustrating flex arms used between the internal cuff and heel counter.

Referring now to FIG. 6, an embodiment of the present invention with an internal cuff 236 interfacing with an internal heel counter 234 does not include a pivot pin at the center of the radius of curvature of the interface. In this embodiment, internal cuff 236 is interconnected with internal heel counter 234 by a tongue and groove arrangement as discussed above. However, forward and rearward arms 258 and 260 bias cuff 236 to a neutral position and hold cuff 236 within groove 240. Forward and rearward arms 258 and 260 form a V-shape with the bottoms of the arms being connected to a heel counter pin secured between the arms and internal heel counter 234 beneath the lowest portion of groove 240. Alternatively, groove 240 may simply be a recess on the sides of internal heel counter 234. The upper ends of arms 258 and 260 are secured to guide holes 262 within heel counter 234 by guide pins 264. Guide pins 264 slide within arcuate guide holes 262 and hold the sides of cuff 236 against heel counter 234. Arms 258 and 260 may be on the interior or exterior of internal heel counter 234. Arms 258 and 260 are preferably constructed from a tough elastomeric material. The remaining details of the embodiment illustrated in FIG. 6 are similar to the embodiments discussed above.

Figure 7:
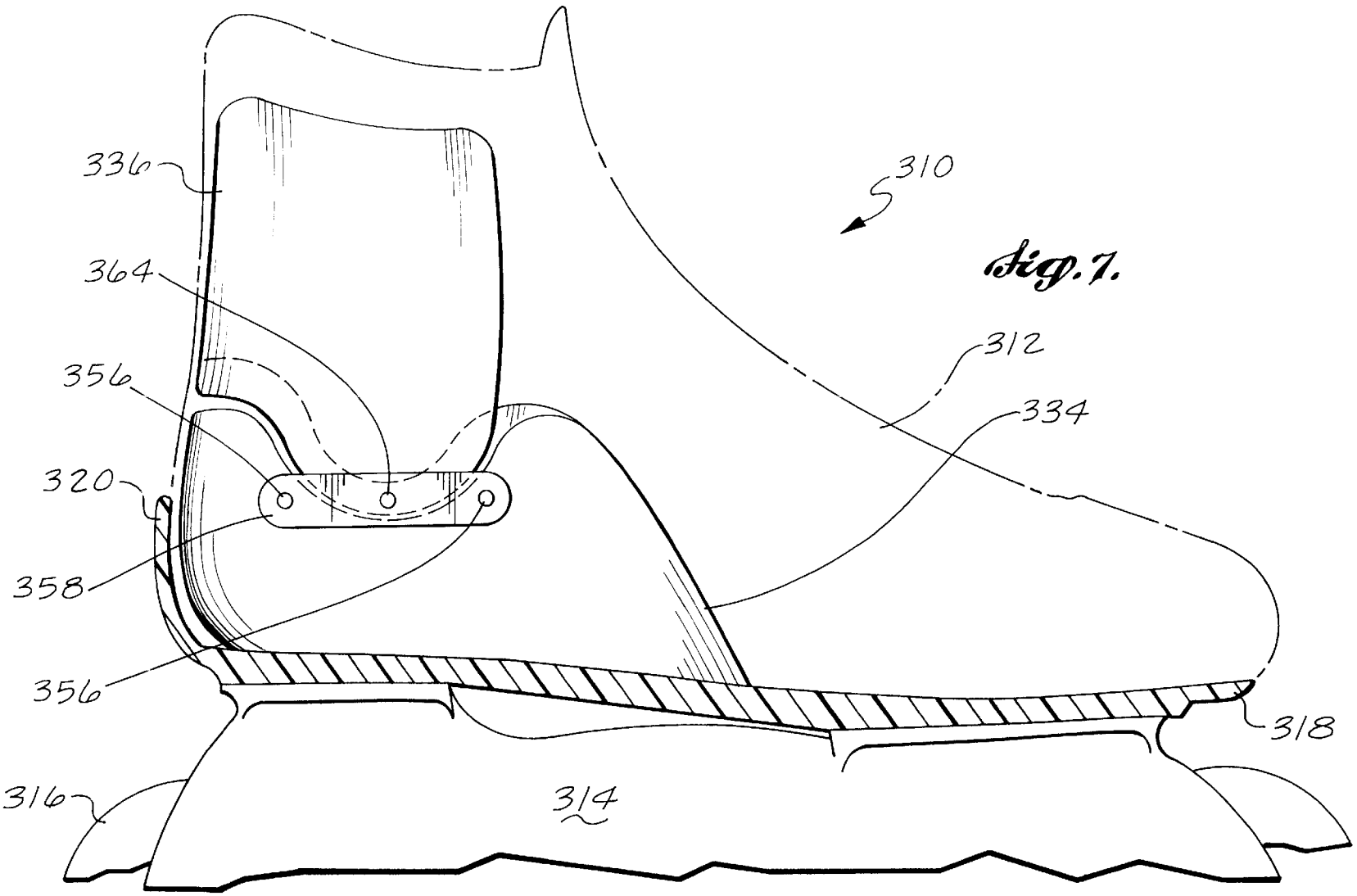
FIG. 7 illustrates another alternate embodiment with a single flex arm to secure the internal cuff to the heel counter.

Referring now to FIG. 7, another alternate embodiment similar to that of FIG. 6 will be described. In this embodiment, a single elastomeric arm 358 is fixedly secured on both ends in a horizontal fashion to internal heel counter 334. Arm 358 is secured across the lower portion of the recess in internal heel counter 334 with the lowermost part of cuff 336 disposed between arm 358 and heel counter 334. Arm 358 is elastic in nature and flexible to permit fore and aft movement of cuff 336 relative to internal heel counter 334. Depending on the elasticity of arm 358, the lower arcuate edge of heel counter 336 may rocker inside the recess created within the top of heel counter 334, thus pulling somewhat upwardly with guide pin 364 on arm 358. The recess within the top of heel counter 334 may have a greater radius of curvature so as to permit such rocketing.

Figure 8:
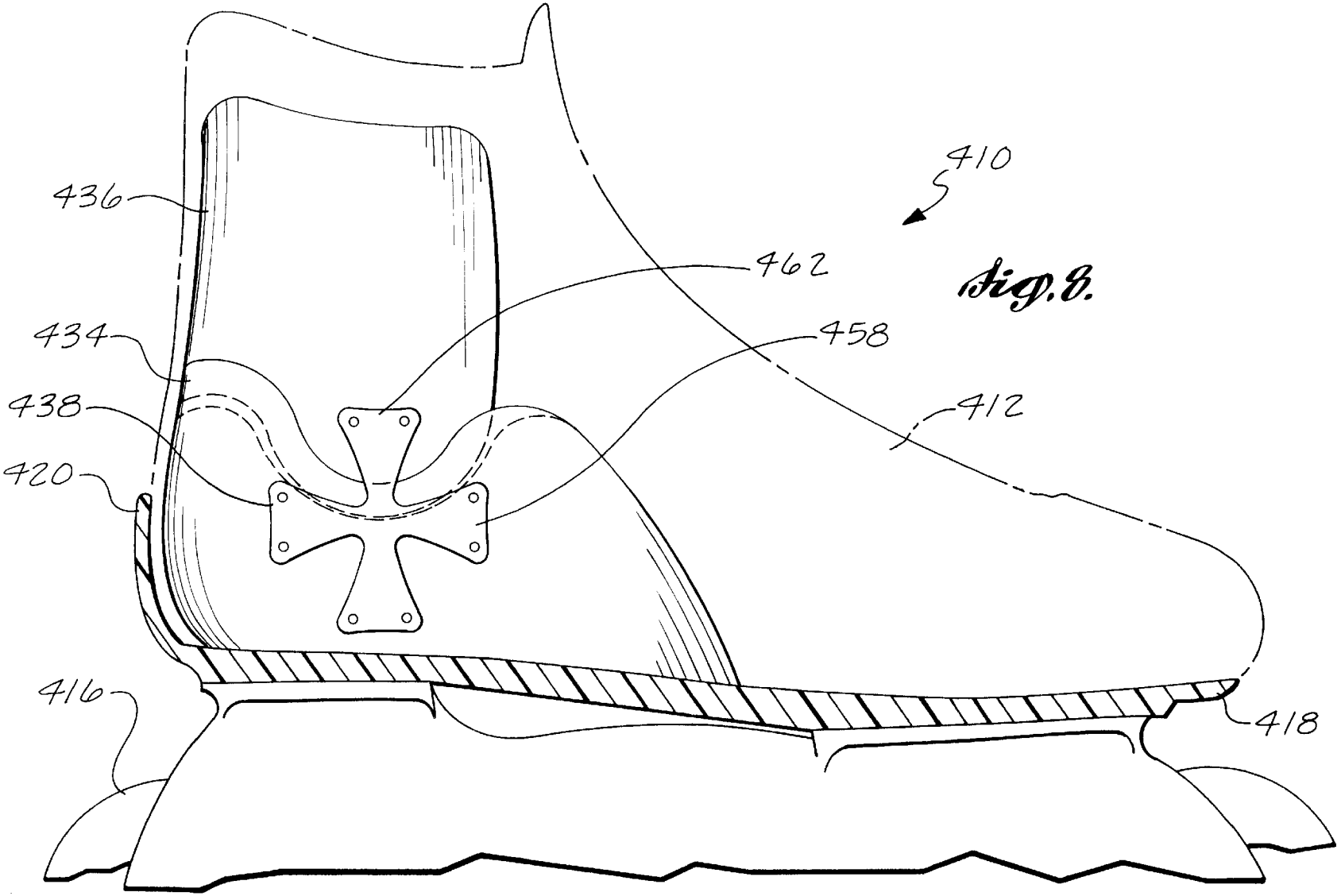
FIG. 8 illustrates another alternate embodiment with a flex cross at the interface between the heel counter and cuff.

Another embodiment will now be discussed in connection with FIG. 8. This embodiment is similar to that of FIGS. 6 and 7 discussed above. In this embodiment a flex cross 438 is interconnected between cuff 436 and internal heel counter 434. The upper arm 462 of flex cross 438 is secured to cuff 436, although alternatively, multiple arms may be connected to cuff 436 with one or more multiple arms connected to internal heel counter 434. Again, cuff arm 462 and heel counter 458 are connected at their ends to cuff 436 and heel counter 434, respectively. Thus, the elastic nature of flex cross 438 allows movement of cuff 436 relative to heel counter 434 with either rockering or pivoting sliding action between the arcuate portions of each.

Figure 9:
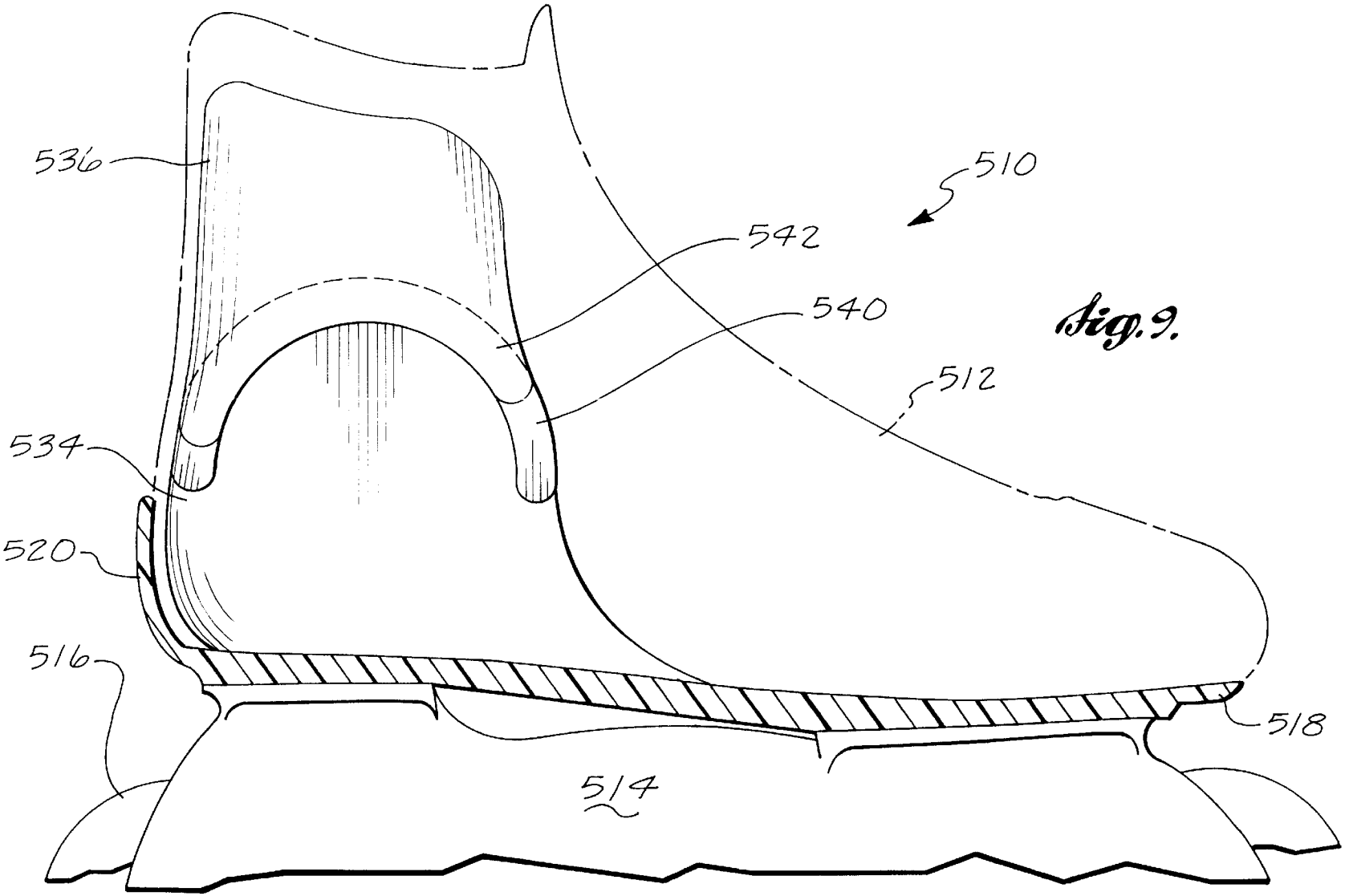
FIG. 9 illustrates an alternate embodiment with the arcuate interconnection between the internal cuff and heel counter being reversed from previous embodiments.

Referring now to FIG. 9, another alternate embodiment, includes reversed arcuate portions of the heel counter 534 and cuff 536 such that cuff 536 includes a concave portion while heel counter 534 contains convex portions. In this case, heel counter 534 may extend upwardly to just above the ankle bones of the skater. Cuff 536 permits movement of the lower leg of the skater relative to internal heel counter 534. Either a recess or a groove 540 with a cuff tongue 542 interfaces between the two elements.

Figure 10:
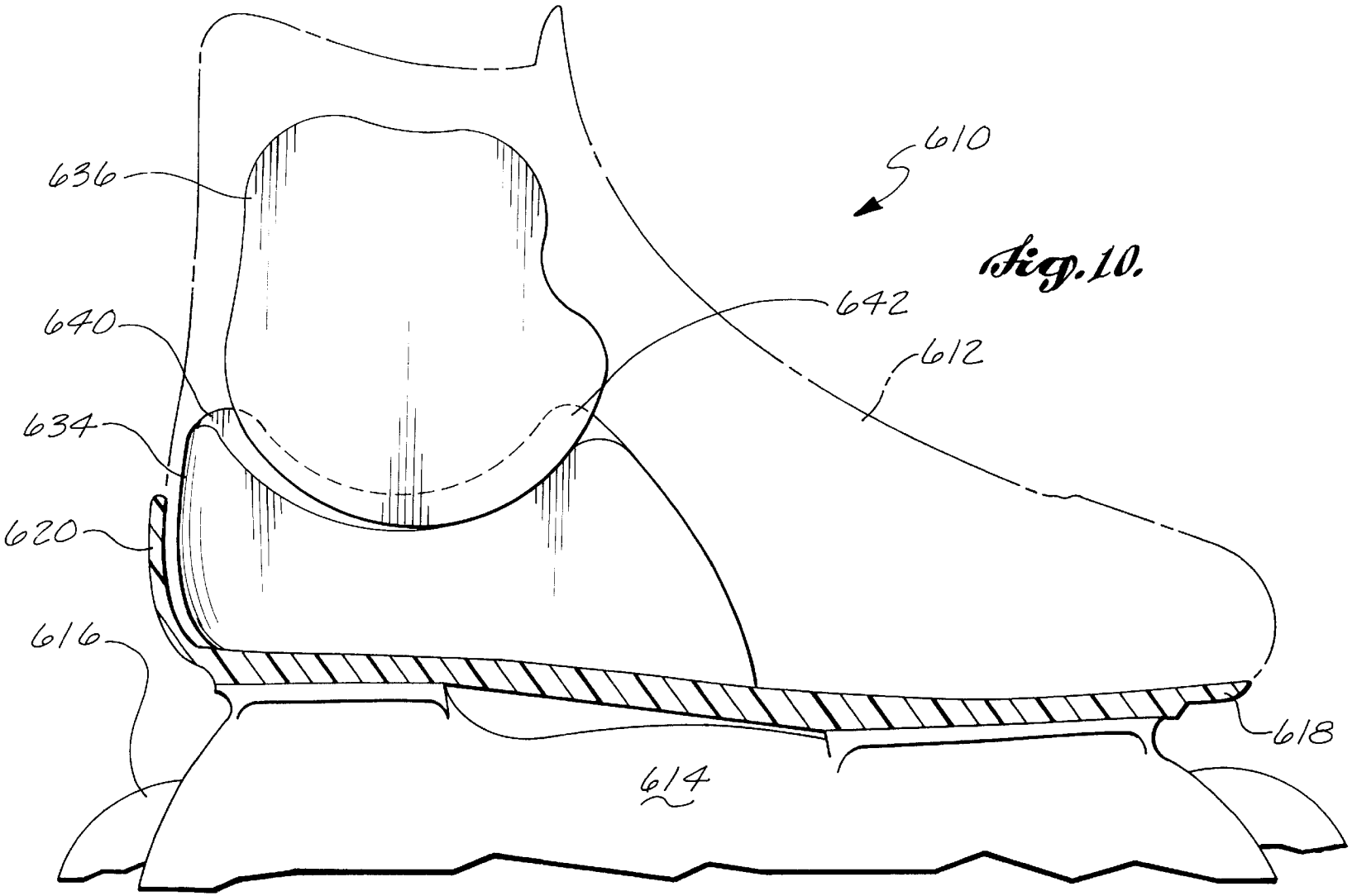
FIG. 10 is a side view of an alternate embodiment without substantial interconnection between the internal cuff and heel counter other than a tongue and groove arrangement.

Referring now to FIG. 10, an embodiment is shown wherein no positive pivotal or linkage connection is created between a cuff 636 and a heel counter 634 other than a tongue and recess or tongue and groove arrangement. The fact that cuff 636 and internal heel counter 634 are held within outer shell 44 of upper 612 provides enough retention of the elements such that no rivet or other fastening means is necessary.

Figure 11:
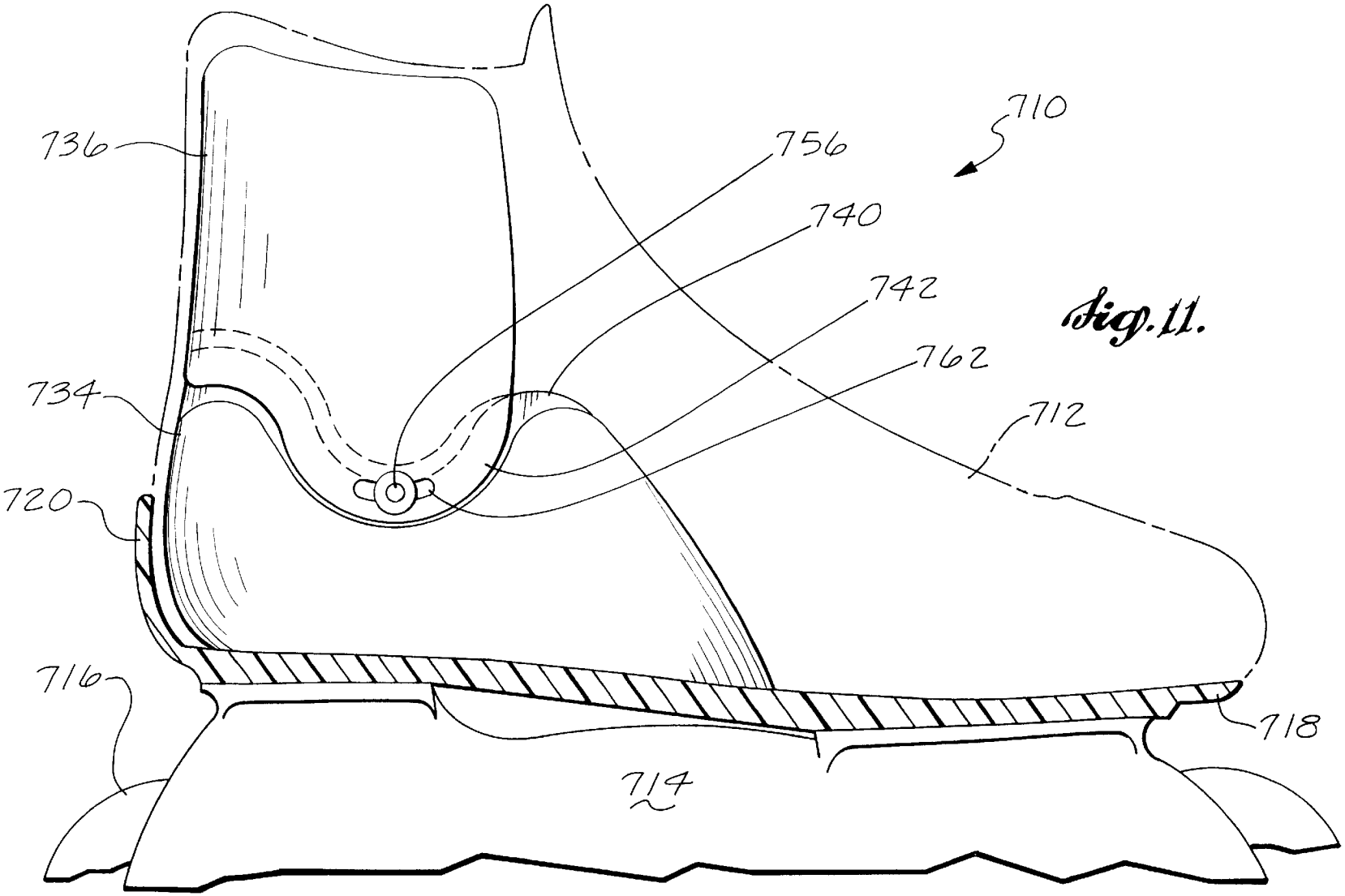
FIG. 11 illustrates another alternate embodiment utilizing a pin and slot arrangement between the internal cuff and heel counter.

FIG. 11 illustrates another alternate embodiment of the invention wherein a recess 740 in the top of the internal heel counter 734 is provided to overlap cuff 736. However, in this embodiment a guide hole 762 in the form of an elongate arcuate slot is provided in the bottom of cuff 736 adjacent a recessed portion 740 of internal heel counter 734. A heel counter pin 756 extends through recess portion 740 and through guide hole 762 to restrict the movement of cuff 736 and provide additional strength thereto.

Figure 12:
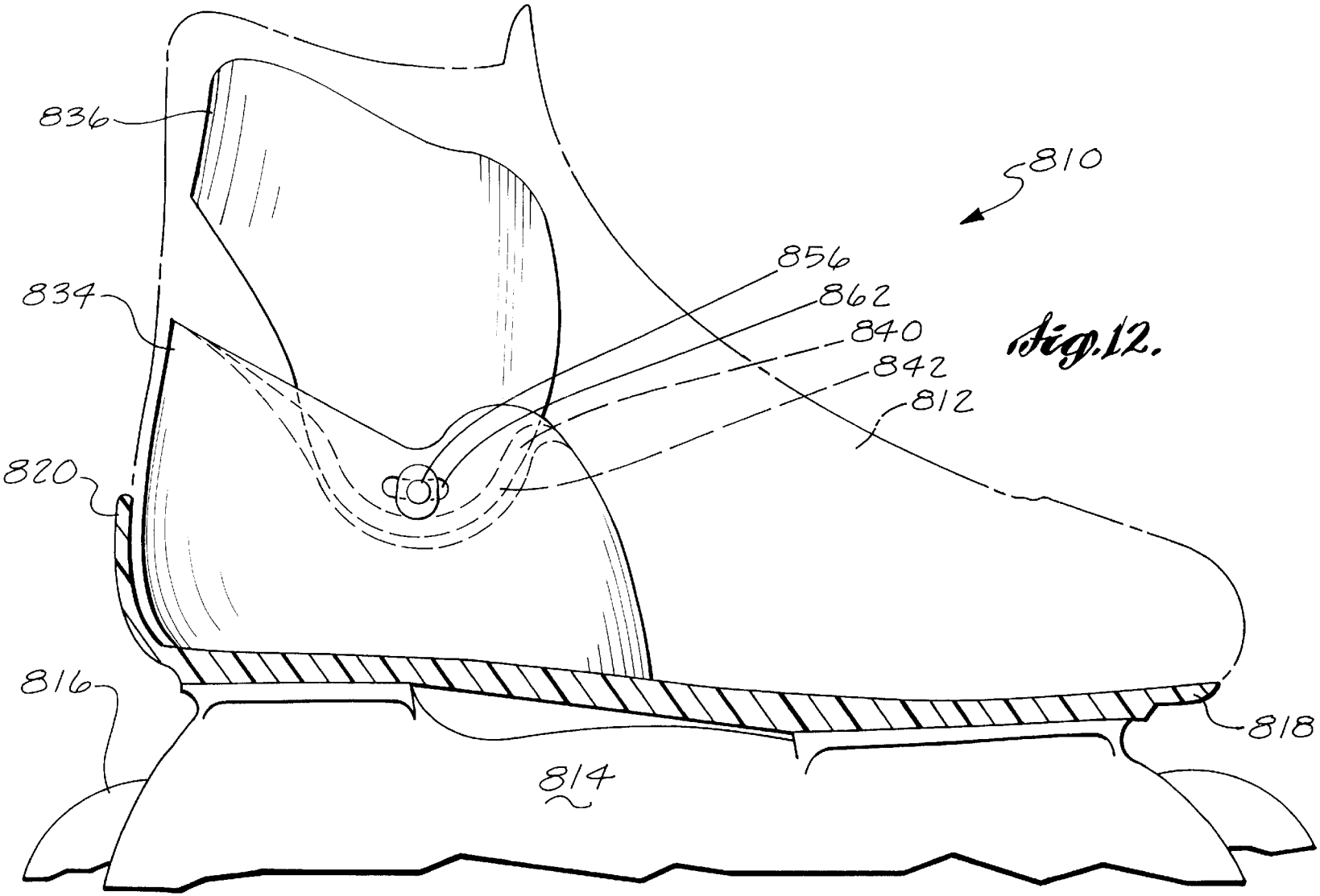
FIG. 12 illustrates another alternate embodiment with a pin and slot arrangement.

A slight rearrangement of this construction is shown in FIG. 12. In FIG. 12 the same guide pin/guide hole arrangement is utilized except that a groove 840 is provided in the bottom of the recess into which a cuff tongue 842 extends. In this embodiment, cuff 836 is further restricted and strengthened from medial and lateral movement since cuff tongue 842 cannot move laterally or medially but only slide within groove 840. Note that the actual pivot axis of cuff 836 may be above heel counter pin 856 due to guide hole 862 being arcuate and providing room for movement. Thus, the pivot axis may be at the ankle bones (malleoli) of the skater without having a rivet or pin projecting inwardly at that same location.

Figure 13:
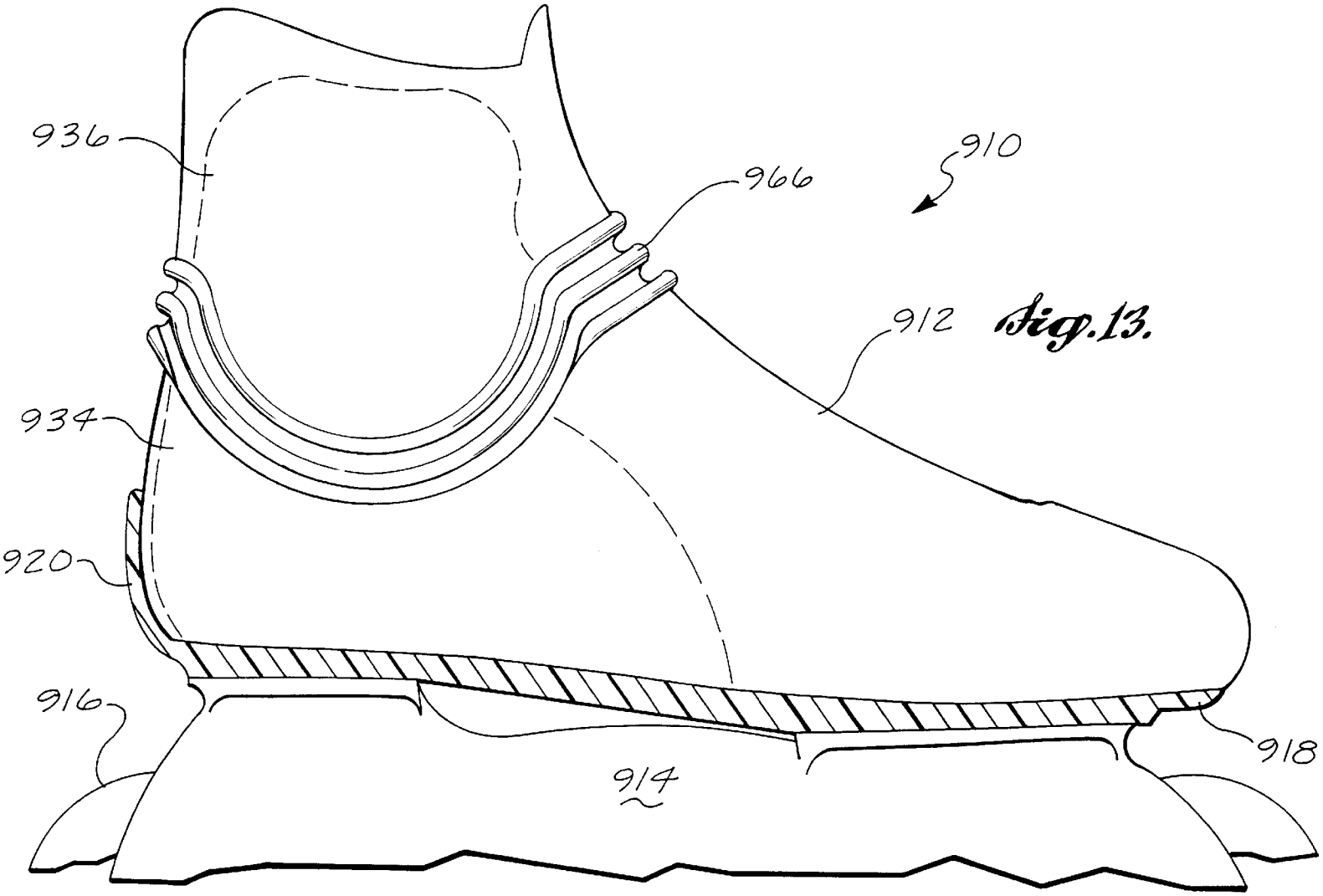
FIG. 13 is an illustration of flex billows that may be used on the external shell of the skate to provide for movement of the cuff portion of the skate relative to the lower portion.

Referring now to FIG. 13, an additional element will be described relating to the external portion of upper 912. In this embodiment, full bellows 966 are provided between ankle portion 926 and four-foot portion 924 to allow the two portions as well as cuff 936 and internal heel counter 934 to move relative to each other. Bellows 966 is an elastic rubbery material that is easily flexible without breaking down. In this embodiment, full bellows 966 extends from the front of the boot down below the ankle bone to above the heel behind the ankle bone in an arcuate fashion. Bellows 966 would then extend around the rear of the skate to a substantially mirror configuration on the other side of the skate.

Figure 14:
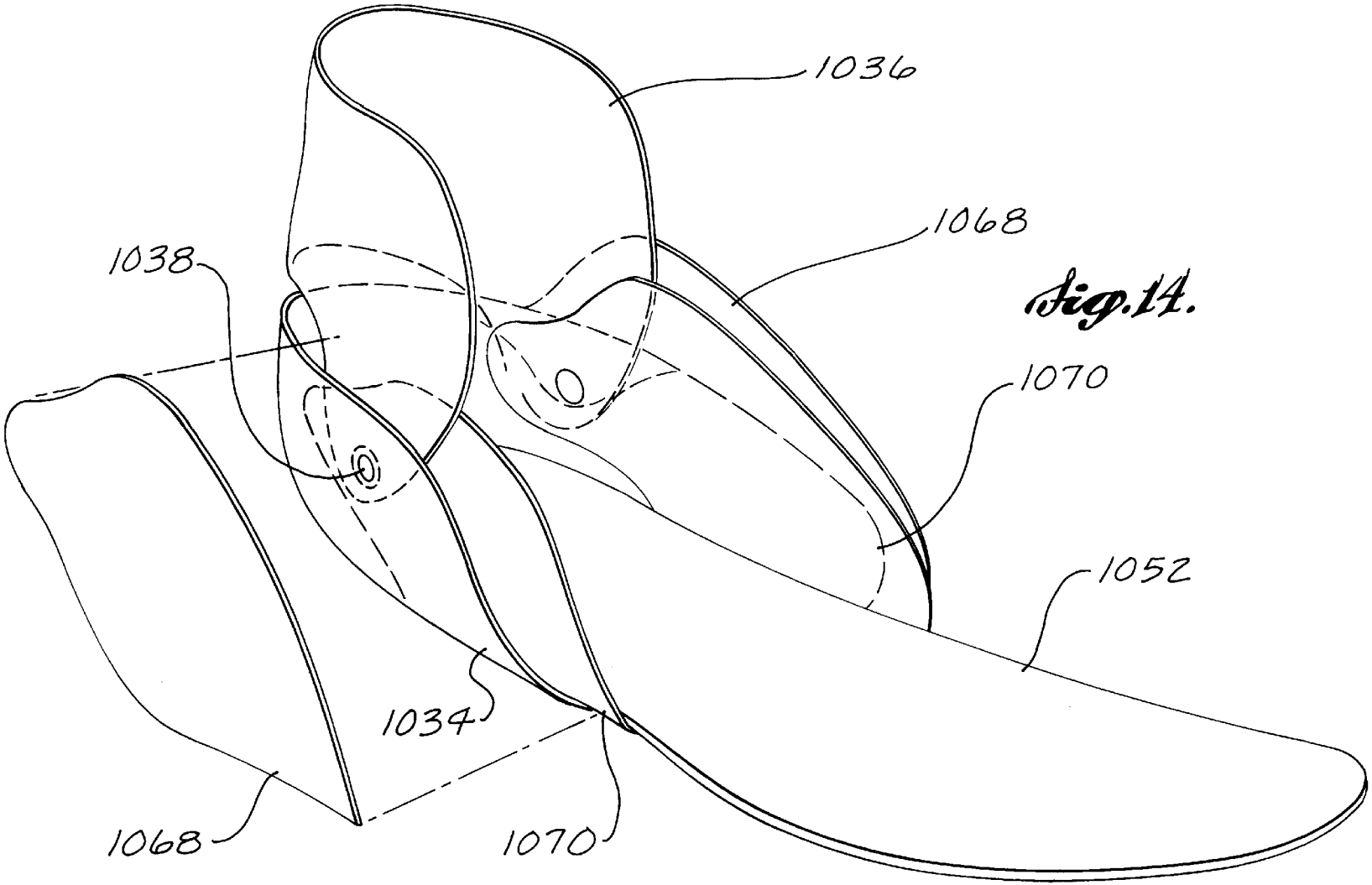
FIG. 14 is a perspective view of a preferred embodiment of the internal support structure of the skate showing inner and outer supports covering the joints between the internal cuff and heel counter.

Referring to FIG. 14, additional support structures preferably added to the basic structure described above relative to FIGS. 1 through 4 will now be discussed. In FIG. 14 the entire soft portion of upper 12 has been removed to expose last board 1052, internal heel counter 1034, and internal cuff 1036. The construction of these three elements and arrangement in FIG. 14 is substantially similar to that discussed above with regard to FIGS. 1 through 4. However, outer supports 1068 and inner supports 1070 have also been added to provide a smooth transition between these elements and for greater support and comfort. Outer supports 1068 are constructed of a plastic material and overlay the cuff and heel counter intersection of the skate and extend slightly forwardly therefrom. This provides additional rigidity to the pivotal and tongue and groove arrangement of the support structure and wraps around the foot of the skater to provide additional support. Likewise, inner supports 1070 cover the intersection between cuff 1036 and heel counter 1034 on the inside of these elements and also cover the inside of pivot pin 1038 which may be a rivet or other fastener. Thus, inner supports 1070 not only provide additional structural support for the foot of the skater to help maintain the proper orientation of the in-line skate, but also provide smooth transition between the elements for maximum comfort. Supports 1068 and 1070 are fixedly secured to internal heel counter 1034. Supports 1068 and 1070 are slidably secured to internal cuff 1036 such that they nest against cuff 1036 so as to not hinder the movement thereof in the fore and aft directions. However, supports 1068 and 1070 further strengthen cuff 1036 in the lateral and medial directions and provide further support around the foot of the skater beyond that provided by heel counter 1034.

While the preferred embodiments of the invention have been illustrated and described, it will be appreciated that various changes can be made therein without departing from the spirit and scope of the invention. The basic concepts and constructions disclosed could be modified such as by placing them on the exterior of the skate on the outside of outer shell 44 or by changing the arrangement in any number of ways while still maintaining basic concepts of having the rigid cuff interconnected to the heel counter in a pivotal fashion.

The embodiments of the invention in which an exclusive property or privilege is claimed are defined as follows:

1. A skate for receiving a foot of a skater, the skate comprising:

(a) a frame having means for riding on a surface;

(b) a rigid base securely attached to said frame, said base adapted to support the bottom of the skater's foot, said base including a heel portion and a toe portion adapted to support areas beneath the heel, ball, and toes of the skater's foot;

(c) a substantially non-rigid upper portion adapted to receive the skater's foot, said non-rigid upper portion adapted to substantially cover the top and ankle of the skater's foot and including a vamp, said non-rigid upper portion being fixed to the heel and toe portions of said rigid base; and (d) a substantially rigid upper portion coupled to said non-rigid upper portion and coupled to said rigid base, said rigid upper portion including an ankle support cuff extending above the skater's ankle when wearing the skate and securable around the skater's ankle for substantial lateral rigidity, said rigid upper portion being adjacent only portions of the non-rigid upper portion, leaving a substantial portion of the vamp of the skate without rigid support directly adjacent thereto while the ankle support cuff is secured around the skater's ankle during use, said non-rigid upper portion extending to above said cuff, wherein said substantially non-rigid upper portion includes an outer shell and said ankle support cuff is disposed beneath said outer shell and is pivotally connected on lateral and medial sides thereof to said rigid base.

2. The skate of claim 1, wherein said substantially non-rigid upper portion includes bellows in a front portion of and a rear portion of an ankle area of said upper portion, said bellows adapted to allow flexible movement of said substantially non-rigid upper portion.

3. The skate of claim 1, wherein said substantially rigid upper portion further comprises an internal heel counter beneath said outer shell, said ankle support cuff being pivotally connected to said internal heel counter.

4. A skate for receiving a foot of a skater, the skate comprising:

(a) a frame having means for riding on a surface;

(b) a rigid base securely attached to said frame, said base adapted to support the bottom of the skater's foot, said base including a heel portion and a toe portion adapted to support areas beneath the heel, ball, and toes of the skater's foot;

(c) a substantially non-rigid upper portion adapted to receive the skater's foot, said non-rigid upper portion adapted to substantially cover the top and ankle of the skater's foot and including a vamp, said non-rigid upper portion being permanently affixed to said rigid base; and (d) a substantially rigid upper portion coupled to said non-rigid upper portion and coupled to said rigid base, said rigid upper portion including an ankle support cuff extending above the skater's ankle when wearing the skate, said rigid upper portion being adjacent only portions of the non-rigid upper portion, leaving a substantial portion of the vamp of the skate without rigid support directly adjacent thereto, said non-rigid upper portion extending to above said cuff, wherein said substantially non-rigid upper portion includes an outer shell and said ankle support cuff is disposed beneath said outer shell, and said substantially rigid upper portion further comprises an internal heel counter beneath said outer shell, said ankle support cuff being pivotally connected to said internal heel counter, further comprising an external heel counter extending upwardly from said base around a heel portion of said upper portion on the outside of said outer shell.

5. A skate for receiving a foot of a skater, the skate comprising:

(a) a frame having means for riding on a surface;

(b) a rigid base securely attached to said frame, said base adapted to support the bottom of the skater's foot, said base including a heel portion and a toe portion adapted to support areas beneath the heel, ball, and toes of the skater's foot;

(c) a substantially non-rigid upper portion adapted to receive the skater's foot, said non-rigid upper portion adapted to substantially cover the top and ankle of the skater's foot and including a vamp, said non-rigid upper portion being permanently affixed to said rigid base; and (d) a substantially rigid upper portion coupled to said non-rigid upper portion and coupled to said rigid base, said rigid upper portion including an ankle support cuff extending above the skater's ankle when wearing the skate, said rigid upper portion being adjacent only portions of the non-rigid upper portion, leaving a substantial portion of the vamp of the skate without rigid support directly adjacent thereto, said non-rigid upper portion extending to above said cuff, wherein said substantially non-rigid upper portion includes an outer shell, and said ankle support cuff is disposed beneath said outer shell and said substantially rigid upper portion further comprises an internal heel counter beneath said outer shell, said ankle support cuff being pivotally connected to said internal heel counter, wherein said heel counter includes two sides with recesses along the inner portion of the tops thereof, said ankle support cuff having lower edges disposed at least partially within said recesses.

6. The skate of claim 5, wherein said recesses include grooves extending downwardly therein and wherein said cuff includes downwardly projecting tongues on either side thereof disposed within said grooves.

7. A skate for receiving a foot of a skater, the skate comprising:

(a) a frame having means for riding on a surface;

(b) a rigid base securely attached to said frame, said base adapted to support the bottom of the skater's foot, said base including a heel portion and a toe portion adapted to support areas beneath the heel, ball, and toes of the skater's foot;

(c) a substantially non-rigid upper portion adapted to receive the skater's foot, said non-rigid upper portion adapted to substantially cover the top and ankle of the skater's foot and including a vamp, said non-rigid upper portion being permanently affixed to said rigid base; and (d) a substantially rigid upper portion coupled to said non-rigid upper portion and coupled to said rigid base, said rigid upper portion including an ankle support cuff extending above the skater's ankle when wearing the skate, said rigid upper portion being adjacent only portions of the non-rigid upper portion, leaving a substantial portion of the vamp of the skate without rigid support directly adjacent thereto, said non-rigid upper portion extending to above said cuff, wherein said substantially rigid upper portion includes a heel counter, said ankle support cuff being pivotally connected to said heel counter, and wherein said heel counter includes arcuate recesses in the sides thereof for receiving said cuff in sliding engagement therewith.

8. The skate of claim 7, wherein said recesses are disposed in the inner sides of said heel counter, the lower portion of said cuff overlapping said heel counter on the inner sides thereof.

9. A skate for receiving a foot of a skater, the skate comprising:

(a) a frame having means for riding on a surface;

(b) a rigid base securely attached to said frame, said base adapted to support the bottom of the skater's foot said base including a heel portion and a toe portion adapted to support areas beneath the heel, ball and toes of the skater's foot;

(c) a substantially non-rigid upper portion adapted to receive the skater's foot, said non-rigid upper portion adapted to substantially cover the top and ankle of the skater's foot and including a vamp, said non-rigid upper portion being permanently affixed to said rigid base; and (d) a substantially rigid upper portion coupled to said non-rigid upper portion and coupled to said rigid base, said rigid upper portion including an ankle support cuff extending above the skater's ankle when wearing the skate, said rigid upper portion being adjacent only portions of the non-rigid upper portion, leaving a substantial portion of the vamp of the skate without rigid support directly adjacent thereto, said non-rigid upper portion extending to above said cuff, wherein said substantially non-rigid upper portion includes an outer shell and said ankle support cuff is disposed beneath said outer shell, wherein said substantially rigid upper portion includes a heel counter, said ankle support cuff being pivotally connected to said heel counter, and wherein said heel counter includes arcuate portions in the sides thereof for receiving complementary arcuate portions of said cuff in sliding engagement therewith.

10. The skate of claim 9, wherein said heel counter is disposed beneath said outer shell, said ankle support cuff being pivotally connected to said heel counter.

11. The skate of claim 10, wherein said heel counter includes recesses having grooves extending downwardly therein and wherein said cuff includes downwardly projecting tongues on either side thereof disposed within said grooves.

12. The skate of claim 11, wherein said substantially rigid upper portion includes support panels disposed on at least one side of the interface between said heel counter and said ankle support cuff, said support panels being fixed to said heel counter, said ankle support cuff being movable relative to said support panels.

13. The skate of claim 9, wherein said arcuate portions of said heel counter include recesses for receiving arcuate portions of said ankle support cuff.

14. The skate of claim 13, wherein said recesses include grooves extending downwardly therein and wherein said cuff includes downwardly projecting tongues on either side thereof slidably disposed within said grooves.

15. The skate of claim 9, wherein said arcuate portions of said heel counter include arcuate slots therein and wherein said cuff further includes pins through the bottom arcuate portions thereof, said pin also extending through said slots in said heel counter.

16. The skate of claim 9, wherein the arcuate portions of said heel counter and the arcuate portions of said cuff are interconnected with arms attached therebetween.

17. The skate of claim 9, wherein said heel counter includes a recess along the arcuate portion thereof for receiving said arcuate portion of said cuff.

18. A skate for receiving a foot of a skater, the skate comprising:

(a) a frame having means for riding on a surface;

(b) a rigid base securely attached to said frame, said base adapted to support the bottom of the skater's foot, said base including a heel portion and a toe portion adapted to support areas beneath the heel, ball, and toes of the skater's foot;

(c) a substantially non-rigid upper portion adapted to receive the skater's foot, said non-rigid upper portion adapted to substantially cover the top and ankle of the skater's foot and including a vamp, said non-rigid upper portion being permanently affixed to said rigid base; and (d) a substantially rigid upper portion coupled to said non-rigid upper portion and coupled to said rigid base said rigid upper portion including an ankle support cuff extending above the skater's ankle when wearing the skate said rigid upper portion being adjacent only portions of the non-rigid upper portion, leaving a substantial portion of the vamp of the skate without rigid support directly adjacent thereto, said non-rigid upper portion extending to above said cuff, wherein said substantially rigid upper portion further includes a heel counter, said heel counter having a groove in the top thereof, at least one lower edge of said cuff being received within said groove.

19. The skate of claim 18, wherein said heel counter and said cuff are pivotally interconnected.

20. A skate for receiving a foot of a skater, the skate comprising:

(a) a frame having means for riding on a surface;

(b) a rigid base securely attached to said frame;

(c) an external heel counter extending upwardly from said base around a heel portion of said skate;

(d) an upper having an outer shell of substantially soft pliable material extending upwardly from said base, said upper defining heel and toe portions interconnected to said base and said upper including a vamp;

(e) a substantially rigid internal heel counter disposed beneath said outer shell and extending around the heel area of the skate to above the top of said external heel counter; and (f) a substantially rigid ankle support cuff pivotally coupled on lateral and medial sides thereof to said internal heel counter and disposed beneath said outer shell, said ankle support cuff being securable about the skater's ankle for substantial lateral rigidity while leaving a substantial portion of the vamp of the upper without rigid support directly adjacent thereto during use.

21. The skate of claim 20, wherein said internal heel counter includes at least one groove along at least a portion thereof for receiving the lower edge of said cuff in substantially sliding engagement therewith.

22. A skate for receiving a foot of a skater, the skate comprising:

(a) a frame having means for riding on a surface;

(b) a base securely attached to said frame, said base adapted to support the bottom of the skater's foot, said base including a heel portion and a toe portion adapted to support areas beneath the heel, ball, and toes of the skater's foot and a substantially rigid heel cup;

(c) a substantially non-rigid upper portion adapted to receive the skater's foot, said non-rigid upper portion adapted to substantially cover the top and ankle of the skater's foot and including a vamp, said non-rigid upper portion being fixed to the heel and toe portions of said base; and (d) a substantially rigid upper portion coupled to said non-rigid upper portion and coupled to said base, said rigid upper portion including an ankle support cuff extending above the skater's ankle when wearing the skate and securable around the skater's ankle for substantial lateral rigidity, said rigid upper portion being adjacent only portions of the non-rigid upper portion, leaving a substantial portion of the vamp of the skate without rigid support directly adjacent thereto while the ankle support cuff is secured around the skater's ankle during use, said non-rigid upper portion extending to above said cuff, wherein said substantially non-rigid upper portion includes an outer shell and said ankle support cuff is disposed beneath said outer shell and is pivotally connected on lateral and medial sides thereof to said rigid heel cup.

* * * * *